US005271421A

United States Patent [19]

Videtzky

[11] Patent Number: 5,271,421

[45] Date of Patent: Dec. 21, 1993

[54] HAIR RETAINING DEVICE

[75] Inventor: Russell J. Videtzky, Northwold, South Africa

[73] Assignee: Northgate Holdings Limited

[21] Appl. No.: 931,342

[22] Filed: Aug. 18, 1992

[30] Foreign Application Priority Data

Aug. 23, 1991 [ZA] South Africa ..... 91/6696

[51] Int. Cl.[5] ..... A45D 24/00

[52] U.S. Cl. ..... 132/200; 132/280; 132/283

[58] Field of Search ..... 132/200, 273, 275, 276, 132/280, 283, 284

[56] References Cited

U.S. PATENT DOCUMENTS

| | | | |
|---|---|---|---|
| 43,914 | 8/1864 | Howells | 132/283 |
| 303,341 | 8/1884 | Thompson et al. | 132/283 |
| 932,888 | 8/1909 | McDonnell et al. | 132/280 |
| 1,103,393 | 7/1914 | Body | 132/283 |
| 1,377,408 | 5/1921 | Dies | 132/283 |
| 1,410,948 | 3/1922 | Miller | 132/283 |
| 1,451,397 | 4/1923 | Kucewicz | 132/280 |
| 1,585,363 | 5/1926 | Bendig | 132/283 |
| 1,596,707 | 8/1926 | Bartlett | 132/283 |
| 2,014,328 | 9/1935 | Hawkinson | 132/283 |
| 3,915,203 | 10/1975 | Solomon | 140/87 |

FOREIGN PATENT DOCUMENTS

| | | |
|---|---|---|
| 230465 | 6/1910 | Fed. Rep. of Germany . |
| 410438 | 4/1923 | Fed. Rep. of Germany . |
| 3145540 | 5/1983 | Fed. Rep. of Germany . |
| 3301946 | 8/1983 | Fed. Rep. of Germany . |
| 465103 | 4/1914 | France . |
| 984016 | 7/1951 | France . |
| 89440 | 5/1921 | Switzerland . |
| 91944 | 12/1921 | Switzerland . |
| 149489 | 11/1931 | Switzerland . |

*Primary Examiner*—Gene Mancene
*Assistant Examiner*—Frank A. LaViola

[57] ABSTRACT

A hair retaining device comprises two co-acting virtually identical circular helical coils. Pockets are defined between the coils. In use, the device is screwed into a user's hair and the hair strands are captively retained in the pockets. The two coils preferably are joined at one common end. The coils are wound on the same hand and are coaxial with each other to form the pockets therebetween. The other ends of the two coils are free and spaced apart.

4 Claims, 2 Drawing Sheets

HAIR RETAINING DEVICE

BACKGROUND TO THE INVENTION

This invention relates to hair retaining device of the type used to retain a wearer's hair in a particular style.

There are many different types of hair retaining devices such as clips, bands, straps and the like which a wearer will wear in his or her hair to retain that hair in a particular style. Prior art devices used for this purpose generally suffer from one or other disadvantage. Clips, for example, tend to clamp or grip onto the hair and tend to crease of damage the hair. Likewise, bands or straps tend to stress the hair in an unacceptable manner. Many devices are difficult to position properly within the hair and can pull on the hair whilst being placed in position or being removed.

For many people, particularly those with fine hair, prior art devices are unsatisfactory in that they do not stay properly in the hair, and hair which is meant to be retained by the device works its way loose and the arrangement becomes unsightly.

SUMMARY OF THE INVENTION

According to the invention, there is provided a hair retaining device comprising, at least one elongate circular helical coil of generally constant diameter and a retaining means for co-action with said coil, said coil and said retaining means defining between them at least three hair retaining pockets, said coil being shaped and configured to be screwed into a user's hair so that a multiplicity of hair strands enter and are captively held in each of said pockets and the device is retained in the user's hair.

The term "pockets" used herein refers to the apparently enclosed spaces between the coil and the retaining means when the device of the invention is viewed in side elevation.

Preferably the coil and the retaining means are integral with each other. The coil and the retaining means may be made of a relatively high strength yet resilient material, such as spring steel. The pitch of the coil is preferably approximately twice that of its diameter. The diameter of the coil may be in the range of 8 to 15 mm, preferably approximately 12 mm, and the length of the coil may be in the range of 40 to 80 mm, preferably approximately 55 mm.

In a preferred arrangement of the invention the retaining means comprises another circular helical coil, the two coils being connected together at one common end with the other ends of the two coils free, the two coils being coaxial with each other. It is preferred that the two coaxial helical coils are angularly offset from each other by 180°.

The invention extends to a method of fixing hair including the steps of providing a hair retaining device which includes at least one circular helical coil, arranging the hair into a particular style, and screwing the device into an appropriate place in the hair to thereby retain the hair in said style. The device is preferably of the type described herein.

These and further features of the invention will be made apparent from the description of two embodiments thereof given below by way of examples. In the description reference is made to the accompanying drawings.

DETAILED DESCRIPTION OF A PREFERRED EMBODIMENT

Figure 1:
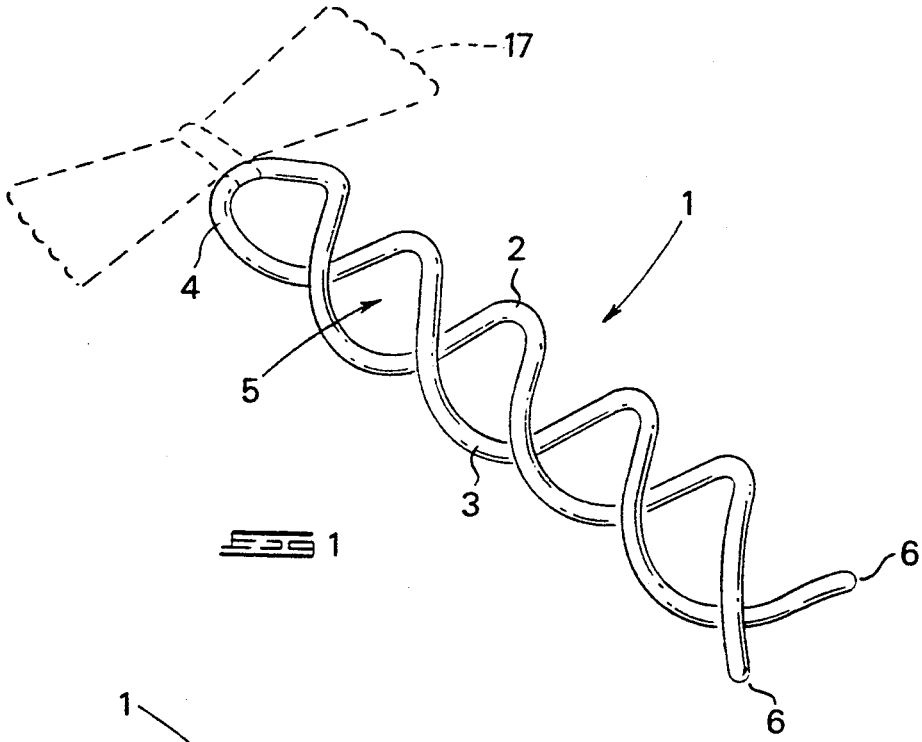
FIG. 1 shows a perspective view of a hair retaining device according to the invention.
Figure 2:
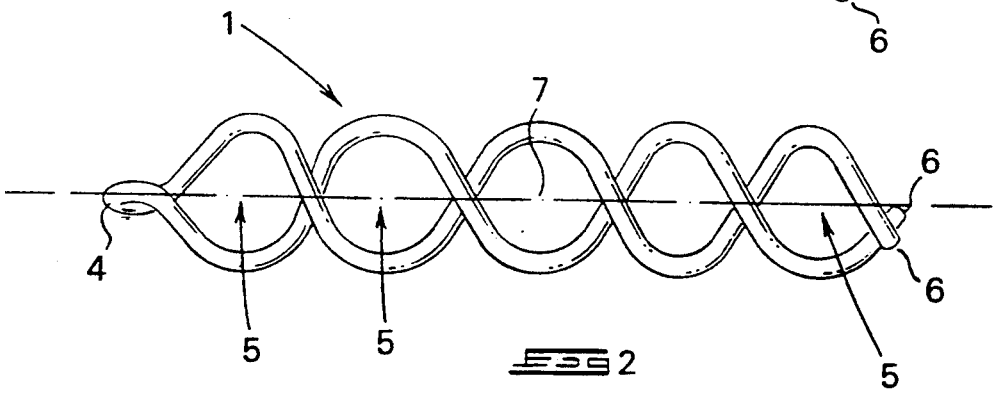
FIG. 2 shows a side view of the device shown in FIG. 1.

Referring to the embodiment shown in FIGS. 1 to 5, a hair retaining device 1 comprises two circular helical coils 2 and 3, the two coils being coaxial and wound on the same hand and intertwined or interleaved with each other. The two coils are of substantially identical length, pitch and diameter and are connected together at one end 4 which, in use, serves as a finger grip for the device. The two coils are offset from each other by 180° so that the coils are spaced apart evenly. The device, when made in this form, is akin to the thread of a two-start screw. It will be noted with specific reference to FIG. 2 that the two coils 2 and 3 define between them a series of pockets or gaps indicated at numeral 5. The free ends 6 of the two coils are equidistant from the end 4. The ends 6 are preferably rounded as shown to prevent scratching the user's head whilst the device is being inserted into the hair. The ends 6 are spaced apart from each other. In use, the device will be screwed on its axis 7 into the hair and the hair strands will be captured within those pockets 5 between the two co-acting helical coils. When the device is screwed into a user's hair, the hair strands will lie generally transverse to the axis 7.

Figure 3:
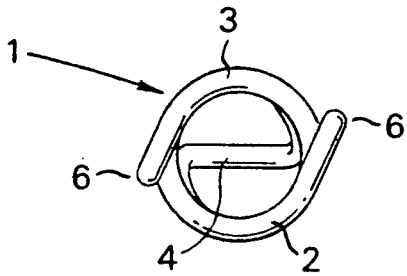
FIG. 3 shows an end view of the device shown in FIG. 1.

To facilitate screwing of the device into the hair, the ends 6 may be splayed slightly as best seen in FIG. 3. This arrangement will help feed the hair strands into the pockets 5. It will be noted that the coils 2 and 3 start directly at the finger grip end 4. This enables the device to be screwed all the way into the hair and a pocket 5 is formed immediately adjacent the end 4. When the device is fully screwed into the hair it will basically be hidden from view, possibly except for the end 4.

Figure 4:
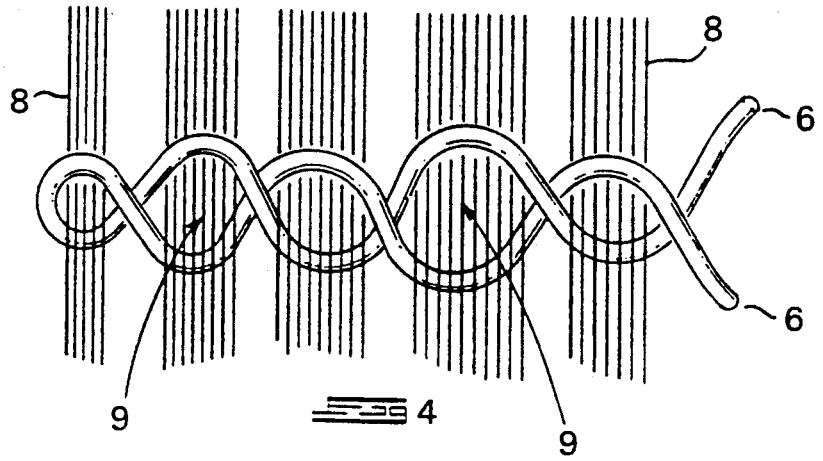
FIG. 4 shows the manner in which the device of FIG. 1 distorts when placed in a user's hair.

The device 1 may be made from a high strength resilient material such as spring steel wire. The resilience is important to ensure the device does not simply deform after having been screwed into the hair and fall out. As shown in FIG. 4, as the device is screwed into a user's hair, the hair strands (indicated by lines 8) will be bunched together in the pockets 5 and will cause the two coils to distort slightly relative to each other as indicated in the drawing. In this distorted condition certain of the pockets are enlarged (as indicated at numeral 9) and the axes of the two coils diverge slightly from the end 4 of the device. The resilience of the device will tend to bias the coils back to their non-distorted (co-axial) condition and this, in turn, will provide a slight gripping action on the user's hair.

To ensure the device operates properly, it is important that there are enough pockets 5 to engage with a reasonable amount of hair to thereby enable the device to satisfactorily retain the user's hair in a range of different styles. It is found that at least three pockets 5 are required for this purpose. The preferred arrangement has five such pockets, that is, each helical coil 2 and 3 has 2.5 convolutions.

Clearly, to operate properly, the device should not be too heavy or too large. A device which has proved to be most successful in practice is made of spring steel and has a coil diameter of approximately 12 mm and a wire thickness of approximately 1.6 mm. Each coil has a pitch of approximately 20 mm so that the two coils are approximately 10 mm apart along the entire length of the device. The device is approximately 55 mm long. Of course, it will be possible to alter these dimensions and proportions. However, if the device is too large, it will be unacceptably bulky and, if it is too small, will not operate properly. It is envisaged that the device will be in the following dimension ranges:

| | |
|---|---|
| Length | 40 to 80 mm |
| Diameter | 8 to 15 mm |
| Coil Pitch | 10 to 30 mm |
| No of convolutions per coil | 1.5 to 4 |
| Pitch to diameter ratio | 1 to 3 |

It is preferred that the device is comprised of or coated with a material which is relatively smooth, but not too smooth. There should be some degree of frictional interaction between the hair and the device to ensure the device is retained within the hair. It is found that a metal device powder coated with enamel which is then baked provides an ideal surface.

The device need not be made from spring steel. Other materials specifically envisaged are plastics or other metals which may be coated with a plastics material or a baked enamel material. It is preferred that the device is relatively inexpensive and light weight so that it is easily retained within the hair of a user but is not overly costly to replace should it be lost. Optionally the device may be coated or covered by a rubberized material for at least a portion of its length to assist in frictional engagement, and thereby retention in the user's hair.

Figure 5:
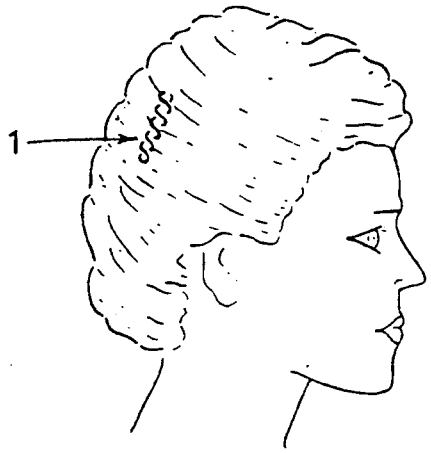
FIG. 5 shows the device of FIG. 1 installed in a wearer's hair.

FIG. 5 depicts one possible mode of wearing such a device. Quite clearly the device may be used with many different hair styles. It will also be possible to employ more than one device. For example, two such devices may be "screwed" into co-action with each other, optionally at 90° to each other. One device will then be screwed through the other device and the co-action of the two devices together will securely retain the two devices within the user's hair and retain the hair tightly in the desired style.

Figure 6:
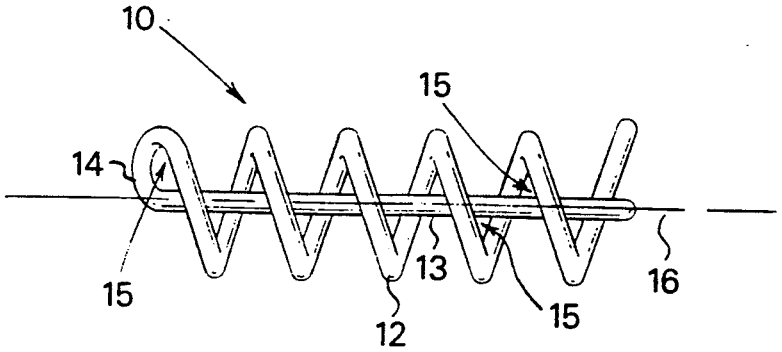
FIG. 6 shows a side view of an alternative device according to the invention.

FIG. 6 depicts a second embodiment of the invention. As shown, the device 10 has a circular helical coil 12 and a retaining means 13 which is a straight section. One end of the straight section 13 and one end of the helical coil 12 are connected together to form a finger grip as shown at numeral 14, and the straight section 13 extends down the centre of the helical coil 12 and lies on the axis 16 of the coil 12. It will be noted that a series of pockets or gaps 15 are formed between the helical coil 12 and the straight section 13. When the helical coil is screwed on its axis 16 into a user's hair, strands of the user's hair will be captured in the pockets 15 and, once so captured, will be retained in those pockets 15 by the co-action between the helical coil and the straight section 13. Thus, the straight section 13 serves to retain the hair of the user in engagement with the helical coil.

It will be appreciated that the device is advantageous since it does not physically clamp or crimp the user's hair and therefore it will not crease or otherwise damage the user's hair. Any gripping action provided by the device is relatively gentle, particularly since the gripping action is between rounded components which are spaced apart from each other. However, the co-action between the coil and the retaining means will be such as to securely retain the users hair in the desired style and retain the device within the user's hair.

If the device is to be used to retain an ornament (such as a bow or jewelry) in the hair the ornament will be attached to the finger grip end of the device. An ornament is depicted by dotted lines 17.

Clearly, it is not essential that the helical coil and the retaining means are integral with each other or made from the same material. It is, however, important that the retaining means does not obstruct or prevent the coil being screwed into the hair. The retaining means may be connected through an articulated connection to the finger grip end of the coil and, once the coil has been screwed into the hair, be securable to or engageable with the coil to form the hair retaining pockets.

In use, the user will gather his or her hair into a selected style and then screw the device into an appropriate location in the gathered hair. The device will then engage with the strands of the hair to hold the hair in that style.

There may be other changes to the form of device depicted in the drawings without departing from the spirit or ambit of the invention.

I claim:

1. A method of fixing hair in a style including the steps of:

providing a hair retaining device having a circular helical coil with at least two convolutions;

arranging the hair in a selected style; and screwing the device into the hair to thereby retaining the hair in that style, wherein the hair retaining device comprises a pair of coaxial helical coils connected together at a common end, each said coil having a helical configuration extending from said common end through a distal end of each coil, the two coils being evenly spaced apart along their length and wound on the same hand, said coils having a diameter of between 8 and 15 mm and a length of between 40 and 80 mm, each said coil being formed having at least two full convolutions so that at least four hair retaining pockets are defined between the two coils, said coils having a pitch to diameter ratio of between 1:1 and 3:1, said coils being formed of a material which is sufficiently resiliently flexible to permit resilient distortion of said coils relative to each other to take place as the device is operatively screwed into a user's hair.

2. A hair retaining device comprising a pair of coaxial helical coils connected together at a common end, each said coil having a helical configuration extending from said common end through a distal end of each coil, the two coils being evenly spaced apart along their length and wound on the same hand, said coils having a diameter of between 8 and 15 mm and a length of between 40 and 80 mm, each said coil being formed having at least two full convolutions so that at least four hair retaining pockets are defined between the two coils, said coils having a pitch to diameter ratio of between 1:1 and 3:1, said coils being formed of a material which is sufficiently resiliently flexible to permit resilient distortion of said coils relative to each other to take place as the device is operatively screwed into a user's hair.

3. The hair retaining device according to claim 2 wherein the two coils are integral with each other.

4. The hair retaining device according to claim 2 wherein the two coils are formed of a high strength resilient metal having a baked enamel coating.

* * * * *